US005647617A

United States Patent [19]

Kajuch

[11] Patent Number: 5,647,617

[45] Date of Patent: Jul. 15, 1997

[54] ADJUSTABLE BACKSET SPRING LATCH AND DEADLOCKING LATCH

[75] Inventor: Pete Kajuch, Brookfield, Wis.

[73] Assignee: Master Lock Company, Milwaukee, Wis.

[21] Appl. No.: 520,290

[22] Filed: Oct. 30, 1995

[51] Int. Cl.[6] ..... E05C 1/00

[52] U.S. Cl. ..... 292/1.5; 292/336.5

[58] Field of Search ..... 292/1.5; 336/1.5, 336/336.5, 337

[56] References Cited

U.S. PATENT DOCUMENTS

| | | | |
|---|---|---|---|
| 4,496,178 | 1/1985 | Best et al. | 292/169.13 |
| 4,687,239 | 8/1987 | Lin | 292/172 |
| 4,711,477 | 12/1987 | Fann et al. | 292/169.14 |
| 4,725,086 | 2/1988 | Shen | 292/337 |
| 4,729,585 | 3/1988 | Lin | 292/337 |
| 4,759,576 | 7/1988 | Ching | 292/337 |
| 4,767,140 | 8/1988 | Lin | 292/337 |
| 4,840,412 | 6/1989 | Shen | 292/337 |
| 4,950,008 | 8/1990 | Fang | 292/337 |
| 5,074,605 | 12/1991 | Fann et al. | 292/337 |
| 5,102,173 | 4/1992 | Schallern | 292/288 |
| 5,257,837 | 11/1993 | Bishop | 292/1.5 |
| 5,364,138 | 11/1994 | Dietrich et al. | 292/1.5 |
| 5,456,503 | 10/1995 | Russell, IV | 292/1.5 |
| 5,458,382 | 10/1995 | Boadwine et al. | 292/337 |

*Primary Examiner*—Steven N. Meyers
*Assistant Examiner*—Donald J. Lecher
*Attorney, Agent, or Firm*—Dorn, McEachran, Jambor & Keating

[57] ABSTRACT

An adjustable backset latch which may also function as a spring latch includes a front case and a rear case telescopically movable relative to the front case. There is a bolt axially movable within the front case and a spring biases the bolt outwardly from the front case. A plunger is positioned adjacent the bolt and axially movable within the front case. A spring biases the plunger outwardly from the front case. A swivel is rotatable in the rear case and there is a retractor movable within the front and rear cases and in engagement with the bolt. A pinion connects the retractor to the swivel such that rotation of the swivel moves the retractor and bolt. Backset, the distance between the axis of rotation of the swivel and the front of the faceplate is adjustable. A flexible backset latching element is mounted on the interior of the rear case and has an outwardly extending projection which passes through an opening in the rear case. There are a pair of longitudinally spaced openings in the front case, with each front case opening being movable into alignment with the rear case opening and when so aligned the flexible backset latching element projection extends through both the rear case opening and the aligned front case opening to define a backset distance between the axis of rotation of the swivel and the front of the faceplate.

14 Claims, 4 Drawing Sheets

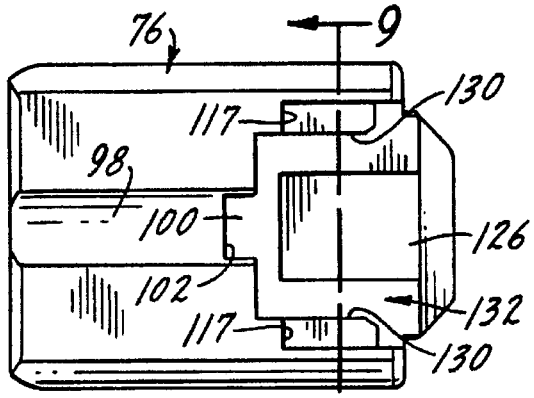
Fig. 8.
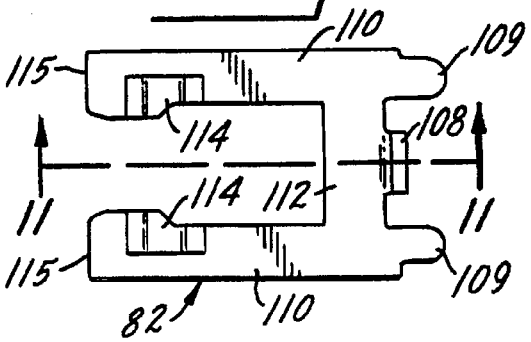
Fig. 10.
Fig. 11.
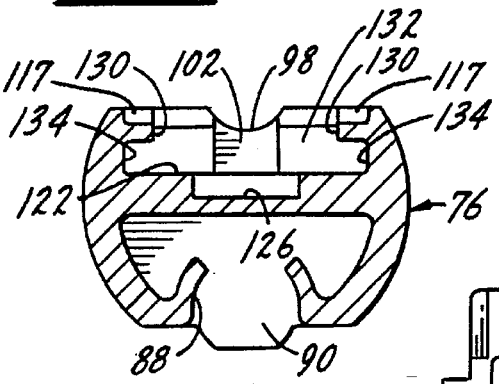
Fig. 9.
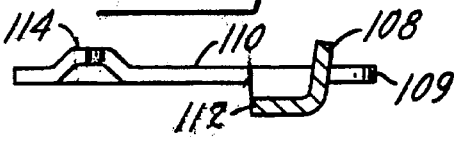
Fig. 12.
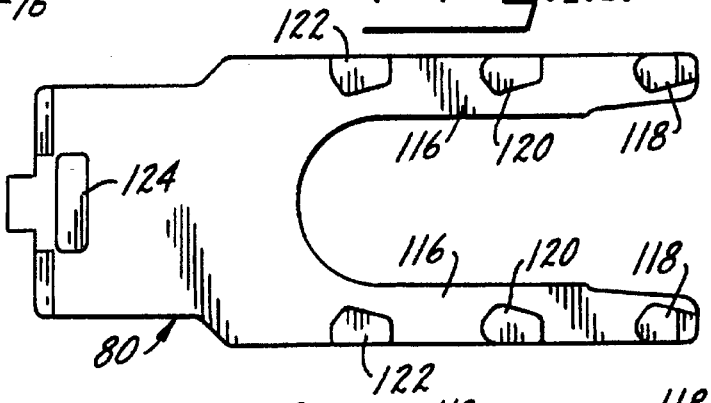
Fig. 13.
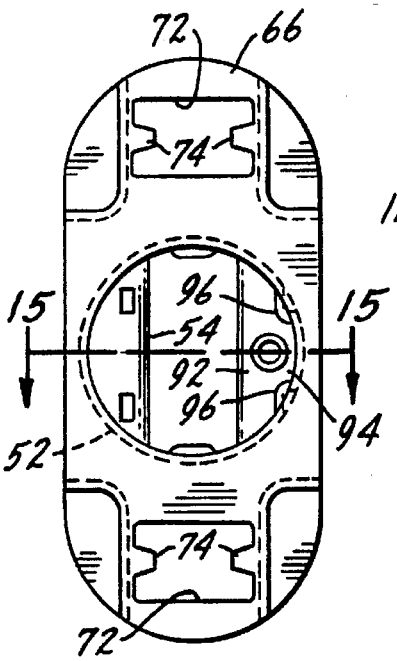
Fig. 14.
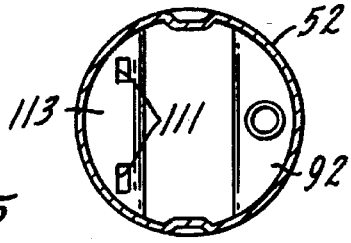
Fig. 16.
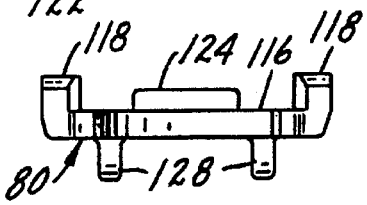
Fig. 13.
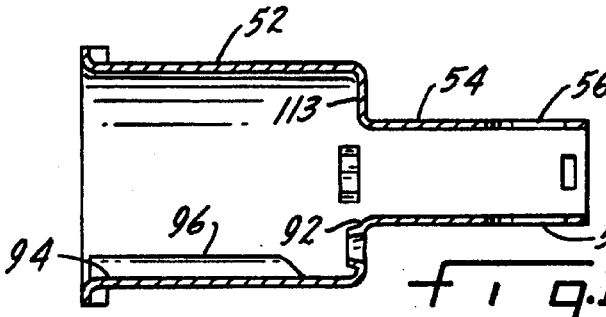
Fig. 15.

ADJUSTABLE BACKSET SPRING LATCH AND DEADLOCKING LATCH

THE FIELD OF THE INVENTION

The present invention relates to an adjustable backset spring/deadlocking latch suitable for use on conventional entry doors. Backset adjustment is easily accomplished by relative linear movement between the telescoping front and rear case assemblies. As is well known in the art, backset adjustment permits the installer to adjust the door hardware to fit the two most common door preparations, 2⅜" and 2¾".

When all of the parts of the described assembly are used, the lock provides an adjustable backset deadlocking latch. When the plunger, plunger spring and stop plate are not used in the assembly, it becomes a spring latch suitable for customary use on interior doors where deadlocking is not required.

Backset is easily accomplished by the use of a spring element which is attached to the inside of the rear case and has a projection which extends outwardly through an opening in the rear case. The rear case opening may be aligned with one of two spaced openings in the front case, with the spaced openings providing the two required backset adjustment positions. The described lock is particularly advantageous in that it has a minimum number of internal components making it economical to produce and reliable in operation.

SUMMARY OF THE INVENTION

The present invention relates to an adjustable backset deadlocking latch which may also function as a spring latch.

A primary purpose is a simple, reliable, adjustable backset latch which provides backset adjustment between the customary distances with a simple linear movement between the two case assemblies.

Another purpose of the invention is to provide an adjustable backset latch of the type described which fits within a common ⅞" diameter hole.

Another purpose is to provide an interchangeable faceplate for an adjustable backset latch of the type described permitting the installer to utilize either a round or square corner style faceplate which then snaps on to the front wall of the latch assembly.

Another purpose is to provide a high strength, high security case design for an adjustable backset latch.

Another purpose is an adjustable backset latch as described utilizing a minimum number of internal components providing an economical latch and one which is reliable in use.

Other purposes will appear in the ensuing specification, drawings and claims.

BRIEF DESCRIPTION OF THE DRAWINGS

The invention is illustrated diagrammatically in the following drawings wherein:

FIG. 8 is a side view of the bolt;

FIG. 9 is a section along plane 9—9 of FIG. 8;

FIG. 10 is a side view of the stop plate;

FIG. 11 is a section along plane 11—11 of FIG. 10;

FIG. 12 is a side view of the retractor;

FIG. 13 is an end view of the retractor;

FIG. 14 is a front view of the front case;

FIG. 15 is a section along plane 15—15 of FIG. 14; and

FIG. 16 is a rear view of the front case.

DESCRIPTION OF THE PREFERRED EMBODIMENT

Figures 1, 3:
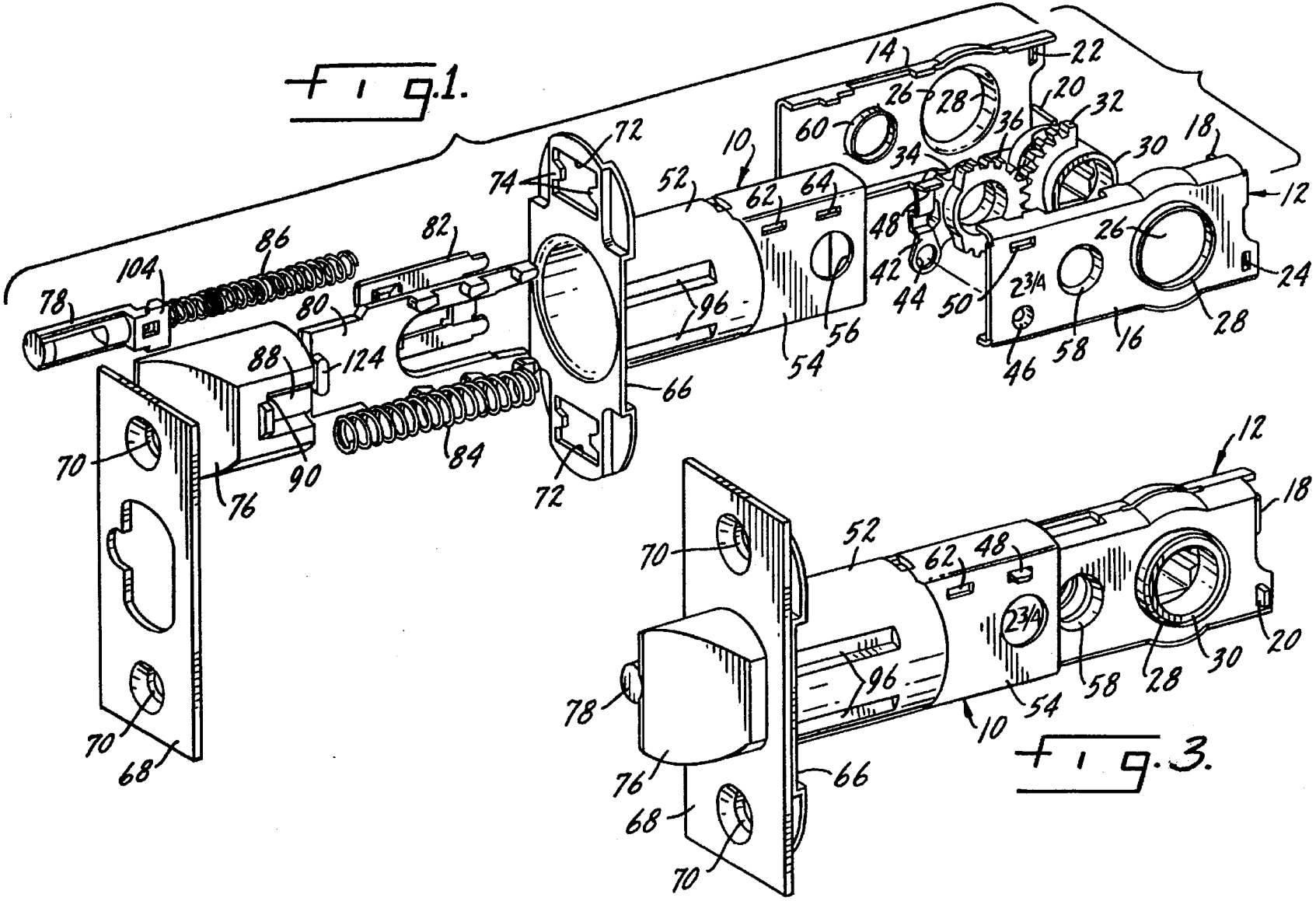
FIG. 1 is a right side exploded perspective of my adjustable backset spring latch.
FIG. 3 is a right side perspective showing the latch in an extended backset position.
Figures 2, 4:
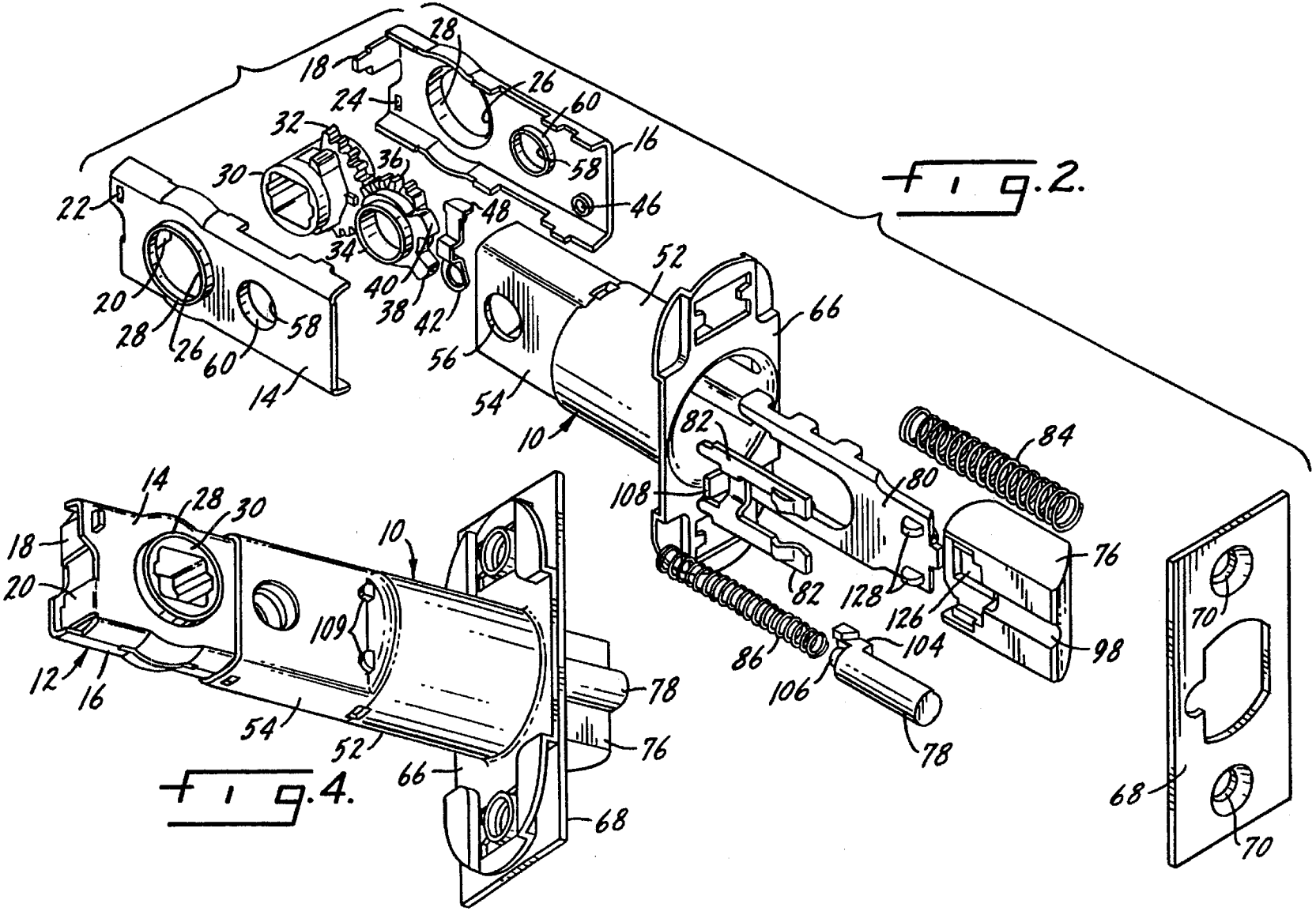
FIG. 2 is a left side exploded perspective of the adjustable backset spring latch of FIG. 1.
FIG. 4 is a left side perspective showing the latch in an inward backset position.
Figure 5:
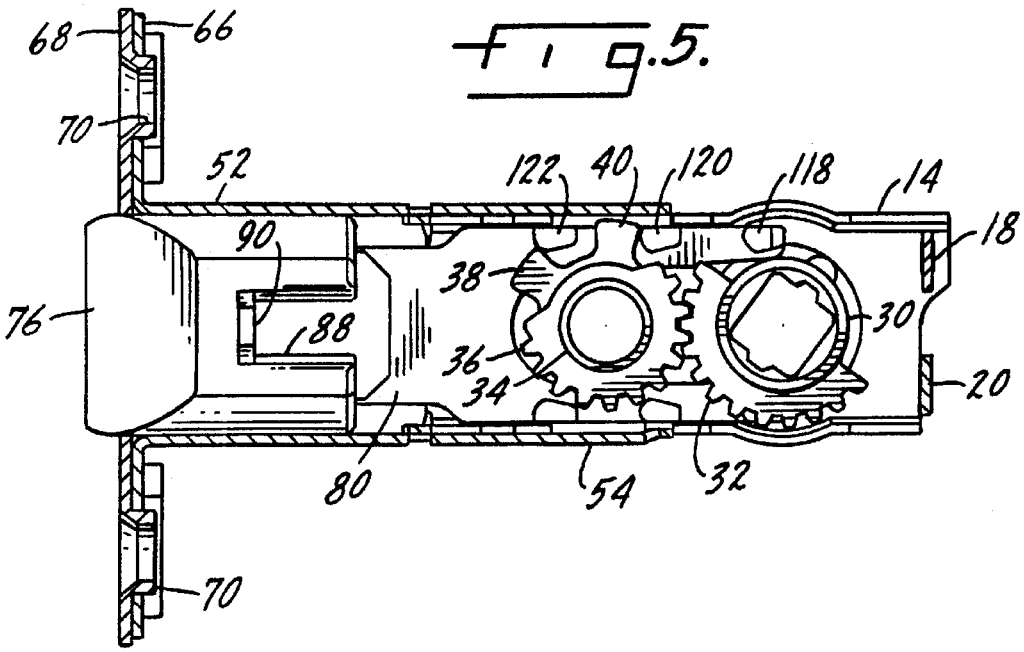
FIG. 5 is a side view, in part section, showing the latch in an inward backset position with the bolt retracted.
Figure 6:
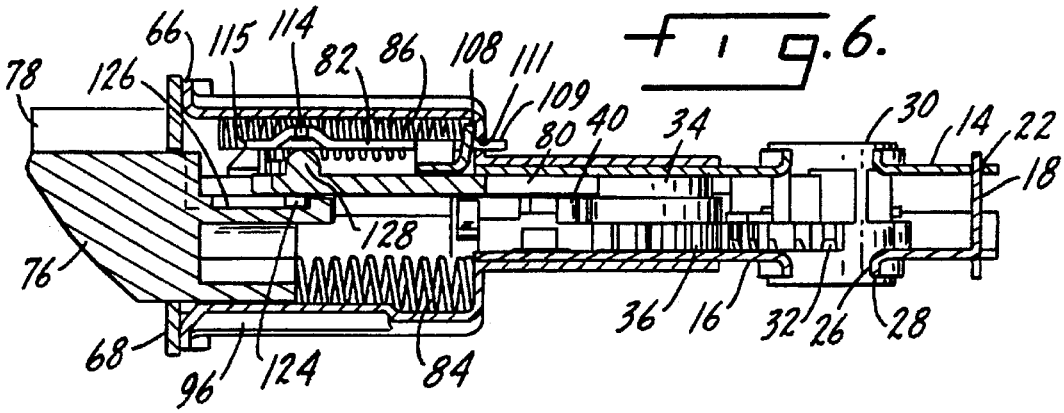
FIG. 6 is a top view, in part section, of the latch in an inward backset position and with the bolt extended.
Figure 7:
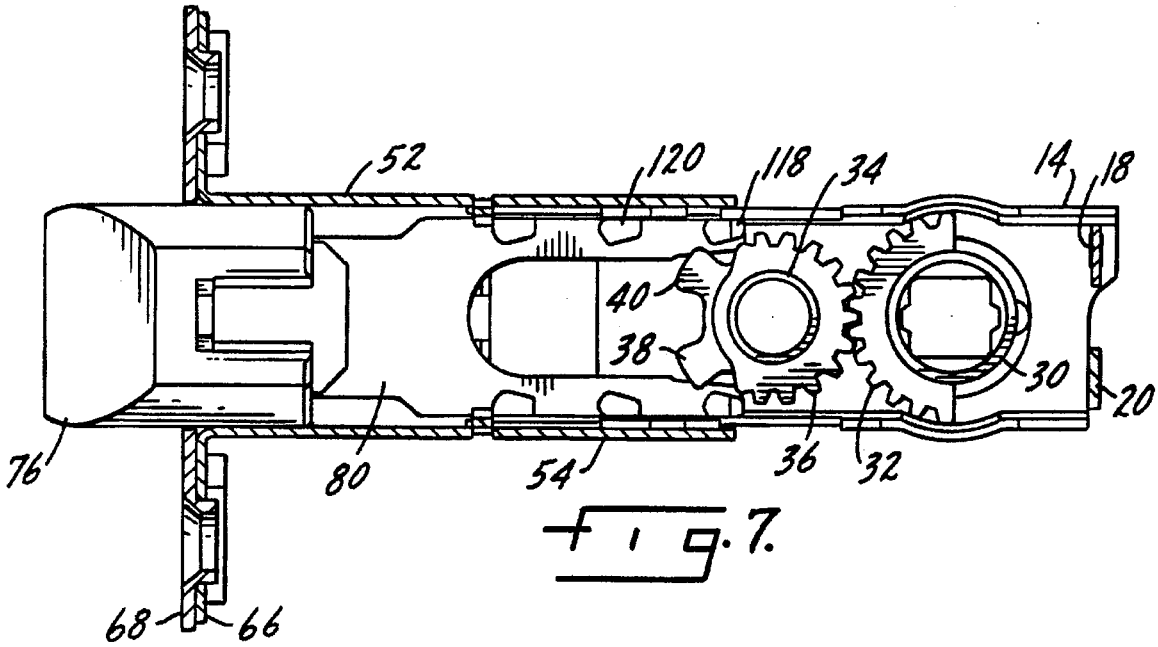
FIG. 7 is a side view, in part section, showing the latch in an extended backset position and with the bolt extended.

As is known in the art, backset is the distance between the center of a lockset and the near edge of the door. There are a variety of adjustable backset latches available for use on conventional entry doors. The purpose of backset adjustment is to permit the installer to adjust the hardware to fit the two most common door preparations of 2⅜" and 2¾". There are problems with present-day backset adjustable latches. Many are not user friendly in that the latch can go out of phase during adjustment making it inoperable and difficult to reset. Many adjustable backset latches require a larger diameter bore than the conventional ⅞" bore. Enlarging a bore from ⅞" to 1" can be difficult for the door installer. Further, adjustable latches are often more complex, requiring extra parts, making the latch higher in cost than fixed backset latches. Many adjustable latches are less secure than a conventional fixed backset latch because the cases have been cut away to allow for backset adjustment.

The present invention overcomes the common problems found in adjustable backset latches. The latch described herein is easy to use, needing only linear movement between the case assemblies to provide backset adjustment. The latch fits into a common ⅞" diameter hole and can be used with an interchangeable faceplate to allow the installer to select either a round or square corner style faceplate. The latch has high strength, providing a high security outer case design which is resistant to torque. There are a minimum number of internal components, making the lock economical to produce and therefore usable in place of fixed backset latches.

The latch assembly of the present invention includes a generally tubular front case 10 and a rear case 12 formed of two case halves 14 and 16. The rear case halves 14 and 16 are joined together through the use of projections 18 and 20 which extend through aligned slots 22 and 24 after which the projections are staked over forming the rear case halves into the assembled rear case 12. There are aligned openings 26 in the rear case halves 14 and 16, each having annular projections 28 which function as supporting journals for a swivel 30 having circumferentially extending gear teeth 32. Customarily, the door lock assembly will include a spindle which will extend through the swivel, with rotation of the spindle being effective to cause operation of the lock.

Directly adjacent the swivel 30 is a pinion 34 having circumferential gear teeth 36 and a pair of circumferentially spaced outwardly extending drive cams 38 and 40. The pinion is rotatably mounted in annular projections 60 formed about aligned openings 58. Rotation of the swivel will cause rotation of the pinion through the meshed gear teeth, with such rotation causing rotation of the drive cams 38 and 40 as described hereinafter.

The rear case assembly is completed by a locking spring 42 which has an opening 44 extending about an inward projection 46 on rear case half 16. The opening 44 and the projection 46 permits the locking spring 42 to be staked onto the inside of rear case half 16, with the spring's outwardly extending projection 48 extending through an aligned opening 50 in rear case half 16. Locking spring 48 is the element which holds the telescoping front and rear cases in one of two backset positions.

The front case 10 includes a cylindrical portion 52 and a rearward portion 54 having flat sides which are formed and adapted to telescopically receive the flat sides of the rear case assembly 12. There is an opening 56 in the front case sides 54, which opening will be in alignment with openings 58 in the rear case 12 when the telescoping front and rear cases are in the 2⅜" backset position.

The front case 52, in the area of the flat walls 54, has a pair of spaced openings 62 and 64 which are the backset adjustment openings. The projection 48 of the locking spring 42 will extend through one of the openings 62 and 64, depending upon the backset adjustment position of the telescoping case assemblies. Thus, one of the openings 62 and 64 will be aligned with the rear case opening 50, depending upon the backset adjustment position, and when so aligned, the projection 48 of the locking spring 42 will extend through the aligned openings. Backset is changed simply by depressing the projection 48 so that it moves into the interior of the case halves, permitting linear telescopic movement of the front and rear cases.

The front case 10 includes a front wall 66 upon which a loose faceplate 68 may be attached. The faceplate 68 has inwardly extending circular ribbed projections 70 which will extend through the openings 72 in the front wall 66 of the front case, with the inwardly extending tangs 74 in the openings 72 serving to hold the faceplate 68 onto the front case. As shown in the drawings, the faceplate has square corners, but it is equally acceptable to use a faceplate with rounded corners. The advantages of having the faceplate attached in the manner described is that the lock assembly may be used with any form of faceplate and the installer simply snaps the faceplate into the front wall openings 72 in the manner described.

The lock assembly elements positioned within the front case 10 include a bolt 76, a plunger 78, a retractor 80 and a stop plate 82. There is a bolt compression spring 84 and a plunger compression spring 86.

The bolt 76 has a pocket 88 with an end wall 90 which supports the forward end of spring 84. The rear end of spring 84 is seated against a wall 92 in the interior of the front case 10. When so positioned, the spring will rest within a channel 94 formed in the interior of the rear case between axially extending projections 96.

The opposite side of the bolt 76 has an axially extending groove 98 which slidably receives the plunger 78. At the inward end of groove 98 there is a small pocket 100 having an end wall 102 which cooperates with an inward extension 104 of the plunger to limit outward movement of the plunger relative to the bolt. The inward end of the plunger 78 has a spring support 106 which centers and aligns one end of the plunger spring 86. The opposite end of the plunger spring 86 is supported by a projection 108 on the stop plate 82. The stop plate 82 has a pair of arms 110 joined adjacent the rear end by a cross bar 112, with the projection 108 being integral with the cross bar. The cross bar has a central depression which forms a pocket to hold the plunger spring 86. Adjacent the forward end of the stop plate 82, each of the legs 110 have upwardly-extending projections 114 which will coact with the retractor in holding the plunger within the lock assembly as described hereinafter. The inward end 109 of the stop plate legs 110 extend through openings 111 in a rear wall 113 of the front case. The forward ends 115 of the stop plate legs 110 will cooperate with stops 117 on the sides of bolt pocket 100.

The retractor 80 has two rearwardly extending legs 116, each of which carries three laterally extending drive lugs indicated at 118, 120 and 122, respectively, lugs 118 being the most forward lugs and lugs 122 the most rearward lugs. At the forward end of the retractor there is a laterally extending projection 124 which rides within a pocket 126 on the same side of the bolt as the plunger. The described projection and pocket limit the relative movement between the retractor and the bolt and connect these two elements for concurrent movement. The opposite side of the forward end of the retractor has a pair of spaced cams 128 which move adjacent the edges 130 of an enlarged bolt pocket 132, the previously described bolt pocket 126 being an inward portion of the larger bolt pocket 132. There are a pair of spaced slots 134 formed in each side of the bolt pocket 132, with the forward end of the retractor riding in the slots 134 during such relative movement between the bolt and the retractor as may be permitted.

The lock assembly will be delivered to the installer or customer in an assembled form with backset adjusted to one of the two common distances between the centerline of swivel rotation and the front of the door. Backset is adjusted, if needed, by inward depression of the projection 48 which pushes it inside of the rear case and whichever slot of the front case is aligned with it. When the projection of the locking spring has been so depressed, the rear case may be telescopically moved relative to the front case. Backset is adjusted by repositioning or realigning one of slots 62 and 64 with the slot 50. When the slots are in the desired alignment, the spring will snap back through the aligned openings holding the telescopic halves in the desired backset adjustment position.

The installer may add the faceplate to the front wall 66 of the front case by using the projections 70 and the opening 72 as described. There are front plates with square corners and front plates with round corners, depending upon the particular application of the lock assembly.

In use, rotation of the swivel 30 will drive the pinion 34 and this rotation may be either clockwise or counterclockwise. Rotation of the pinion will move its drive cams 38 and 40 after a small degree of lost motion into contact with the drive lugs on the retractor. When the lock assembly is in the 2⅜" backset position the cams on the pinion will coact with the forward two drive lugs 118 and 120 in moving the retractor back to an unlocked position. In the 2¾" backset position, the rear drive lugs 120 and 122 will coact with the drive cams on the pinion for bolt and retractor movement. When the pinion is drawing the retractor to the rear it will move the retractor and the bolt, because of the interconnection between the bolt and the retractor, against the force of compression spring 84. Thus, as is common in lock assemblies, rotation of the swivel has the effect of withdrawing the bolt out of the door frame permitting the door to be opened. When the swivel is released, the compression spring will move the bolt and the attached retractor back to the position in which the bolt extends out of the front plate 68.

When the door is in a closed position the door frame strike plate will have moved the plunger 78 inwardly into the lock assembly against the force of plunger spring 86. When the plunger is so moved, the stop plate 82 will pivot in a counterclockwise direction, due to spring pressure, so that the depressions 114 of the stop plate will move onto the cams 128 of the retractor, and the forward ends 115 of the stop plate legs 110 will be positioned adjacent bolt stop walls 117, preventing the bolt from moving inwardly. This effectively prevents the bolt from being pushed inwardly by outward pressure thereon, as without current movement of the retractor, the bolt cannot move. Thus, the inward movement of the plunger by the described mechanism has the effect of utilizing the stop plate to prevent the bolt from inward movement, unless the bolt and retractor are concurrently moved by rotation of the swivel. This provides deadlocking, as the bolt cannot be moved by end pressure. It can only be moved by rotation of the swivel. When the swivel is rotated, such that the retractor pulls on the bolt, the cams on the retractor will permit the retractor and thus the bolt to be moved rearwardly causing the stop plate to pivot out of its locked position so that the bolt may move into the fully retracted position.

The plunger mechanism described is used to provide a deadlocking assembly. When the plunger, plunger spring and stop plate are not included in the lock assembly it becomes a spring latch suitable for customary use on interior doors where deadlocking is not required.

Of importance in the invention is the simplified linear movement to change backset. The locking spring is depressed and the telescoping front and rear cases are moved relative to each other from one backset position to another. Also of importance is the combination of the swivel, pinion, retractor and bolt for moving the bolt between the extended and retracted positions. The stop plate interacts with the retractor and the plunger to hold the bolt in an extended position when the plunger is depressed, preventing end pressure on the bolt from causing inward movement of the bolt. The stop plate and the plunger provide a deadlocking function for the lock assembly.

Whereas the preferred form of the invention has been shown and described herein, it should be realized that there may be many modifications, substitutions and alterations thereto.

The embodiments of the invention in which an exclusive property or privilege is claimed are defined as follows:

1. An adjustable backset latch including a front case and a rear case telescopically movable relative to the front case, a bolt axially movable within said front case, means limiting telescopic movement between said front case and said rear case to an axial direction and preventing relative rotation between said front case and said rear case, spring means biasing said bolt outwardly from said front case, a swivel rotatable in said rear case, a retractor movable within said front and rear case and in engagement with said bolt, means connecting said swivel and retractor whereby rotation of said swivel moves said retractor and bolt, and means for adjusting the backset distance between the axis of rotation of said swivel in said rear case and the front of said front case including a flexible backset latching element mounted on the interior of said rear case and having an outwardly extending projection, an opening for said projection in the rear case whereby said projection is extendable outwardly through said rear case opening, a pair of longitudinally spaced openings in said front case, each front case opening being movable into alignment with said rear case opening, with said projection extending through said rear case opening and a front case opening when there is alignment to latch said front and rear cases against relative movement and to thereby define a backset distance between the axis of rotation of said swivel and the front of said front case.

2. The adjustable backset latch of claim 1 wherein the means connecting said swivel and said retractor include a pinion mounted for rotation in said rear case.

3. The adjustable backset latch of claim 2 wherein said swivel and pinion have mating gear surfaces to transfer rotation of said swivel into rotation of said pinion.

4. The adjustable backset latch of claim 3 wherein said pinion has drive cams thereon engageable with said retractor.

5. The adjustable backset latch of claim 4 wherein said retractor has spaced drive lugs thereon which engage with said pinion drive cams.

6. The adjustable backset latch of claim 5 wherein said retractor has three longitudinally spaced drive lugs with the forward two lugs being engaged by said pinion drive cams at one backset distance and the rearward two drive lugs of said retractor being engageable by said pinion drive cams at the other backset distance.

7. The adjustable backset latch of claim 6 wherein said swivel and said pinion can be rotated in either a clockwise or counterclockwise direction, said retractor having three spaced sets of drive lugs for engagement with said pinion drive cams.

8. The adjustable backset latch of claim 1 wherein said bolt has a slot, said spring means being a coiled spring positioned in said slot, with one end of said coiled spring being in contact with a wall of said front case.

9. The adjustable backset latch of claim 8 wherein the engagement between said bolt and retractor includes a projection on said retractor and a slot in said bolt.

10. The adjustable backset latch of claim 1 including a plunger positioned adjacent said bolt and axially movable within said front case, a spring biasing said plunger outwardly from said front case.

11. The adjustable backset latch of claim 10 wherein said bolt has a groove receiving said plunger, a stop plate positioned within said front case and supporting one end of said plunger spring.

12. The adjustable backset latch of claim 11 including cooperating means on said stop plate and bolt, with said stop plate pivoting when said plunger moves inwardly to engage said bolt to thereby prevent inward movement of said bolt from pressure on the outward end of said bolt.

13. The adjustable backset latch of claim 12 wherein there are engagement means on said stop plate and retractor including a cam on said retractor and a depression on said stop plate.

14. The adjustable backset latch of claim 13 wherein said stop plate has a pair of rearwardly extending projections which extend through a wall of said front case.

* * * * *